United States Patent [19]

Tusch

[11] Patent Number: 4,747,365

[45] Date of Patent: May 31, 1988

[54] TOILET ROLL DISPENSER

[75] Inventor: Klaus N. Tusch, London, England

[73] Assignee: Gry AG, Alpenstrasse, Switzerland

[21] Appl. No.: 908,675

[22] Filed: Sep. 17, 1986

[30] Foreign Application Priority Data

Sep. 23, 1985 [GB] United Kingdom ..... 8523484

[51] Int. Cl.[4] ..... B05C 1/08; B05C 1/16

[52] U.S. Cl. ..... 118/221; 118/235; 118/247; 118/249

[58] Field of Search ..... 118/247, 235, 249, 221

[56] References Cited

U.S. PATENT DOCUMENTS

| | | | |
|---|---|---|---|
| 3,025,829 | 3/1962 | Smith | 118/221 |
| 3,084,664 | 4/1963 | Perlman et al. | 118/235 |
| 3,388,953 | 6/1968 | Browning | 118/221 X |

*Primary Examiner*—John P. McIntosh

*Attorney, Agent, or Firm*—Parkhurst & Oliff

[57] ABSTRACT

A toilet roll dispenser, comprising a holder for a toilet roll, a medicament reservoir, and means operable selectively to apply medicament to a part of a surface of a toilet roll as it is dispensed.

8 Claims, 5 Drawing Sheets

TOILET ROLL DISPENSER

The invention relates to a toilet roll dispenser, particularly for high quality of "soft" toilet tissue.

Toilet rolls are used in the home, and in lavatories, bathrooms or rest-rooms of public places such as hotels, sports arenas, restaurants, hospitals, in fact their use is generally universal. Soft tissue is popular. It is also increasingly popular and/or desirable to medicate toilet tissue, but such medication with medicament which is usually a liquid, gel or the like generaly weakens the tissue.

It is accordingly an object of the invention to seek to provide a toilet roll dispenser which mitigates the disadvantages of the prior art.

According to a first aspect of the invention there is provided a toilet roll dispenser, comprising a holder for a toilet roll, a medicament reservoir, and means operable selectively to apply medicament to a part of a surface of a toilet roll as it is dispensed.

The means may comprise a train of rolls round which the toilet roll is trained from the holder to an end of the dispenser, and one of the rolls may be movable between two positions in one of which medicament is applied to the toilet roll.

The reservoir may include a roller which is partly immersed in medicament and which may be contacted by the toilet roll in the one position of the movable roll whereby medicament is applied to the roll.

The roller may comprise two spaced roller parts whereby to apply two separate strips of medicament to the toilet roll which together have a width less than the width of the toilet roll.

The roller may comprise a single roller part which applies a single strip of medicament to the toilet roll which may have a width less than the width of the toilet roll.

The movable roll may be movable between the two positions by a manually grippable handle device.

The handle device may be an extension of a spindle of the fixed roll which projects exteriorly of the dispenser.

The movable roll may be moved substantially vertically to the one position.

The dispenser may comprise a wall-mountable housing in which the holder, medicament reservoir and rolls may be housed.

According to the invention there is provided a dispenser for a strip or strand of material, a holder for such strip or strand, a reservoir for a liquid, gel or the like, and means operable selectively to apply liquid, gel or the like to a part of a surface of the strip or strand as it is dispensed.

A toilet roll/tissue dispenser embodying the invention is hereinafter described, by way of example, with reference to the accompanying drawings.

Figure 1:
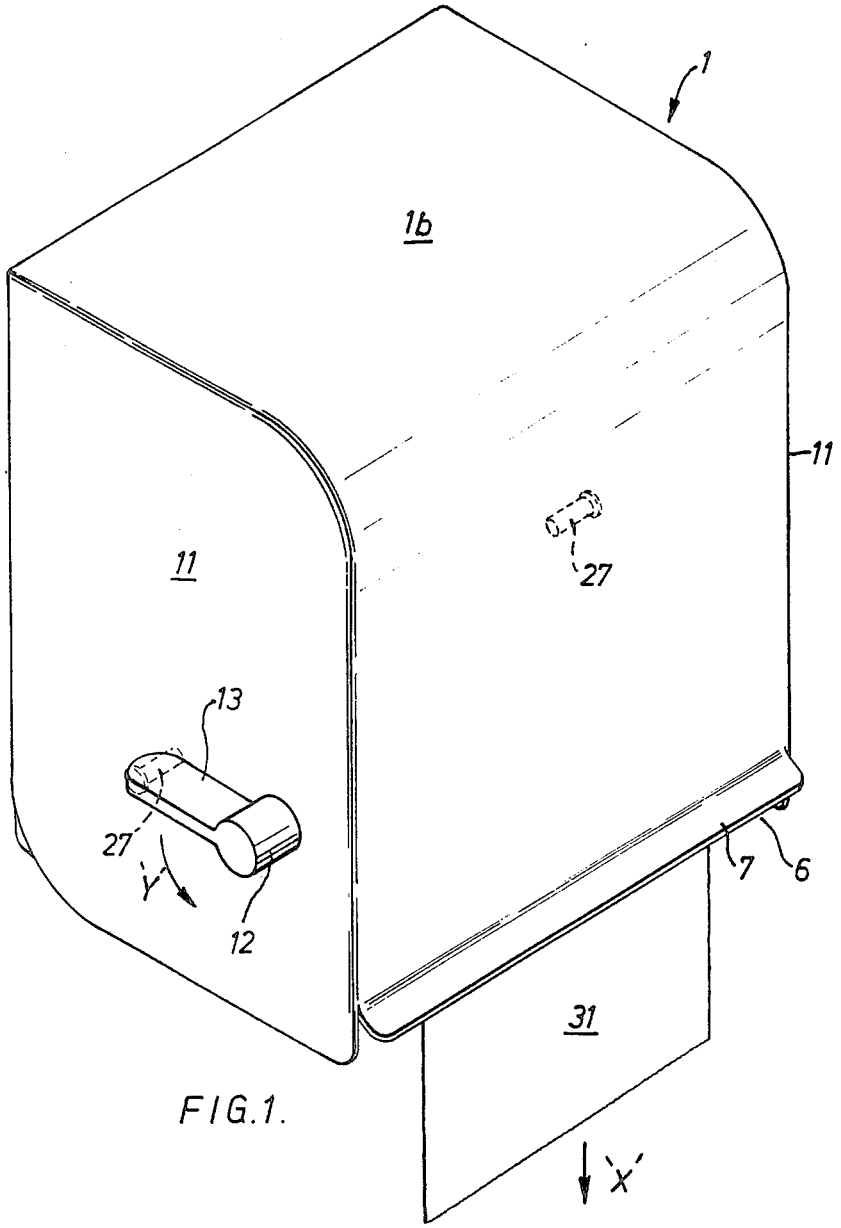
FIG. 1 is a schematic perspective view of a toilet roll/tissue dispenser according to the invention.
Figure 1A:
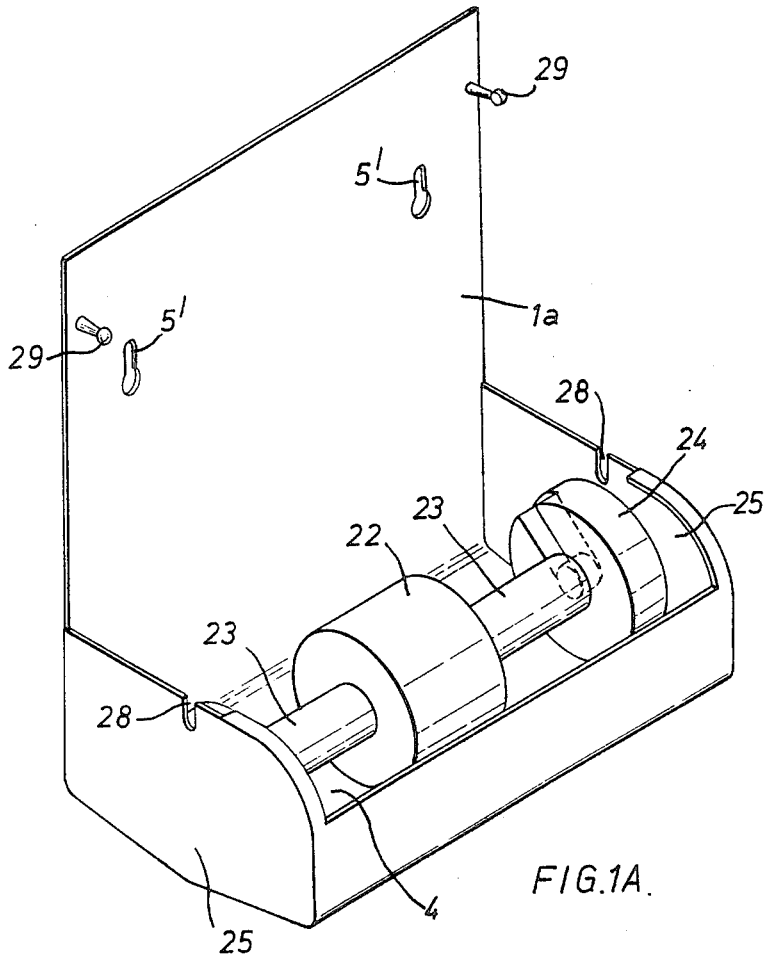
FIG. 1A is a schematic perspective view of part of the dispenser of FIG. 1.
Figure 1B:
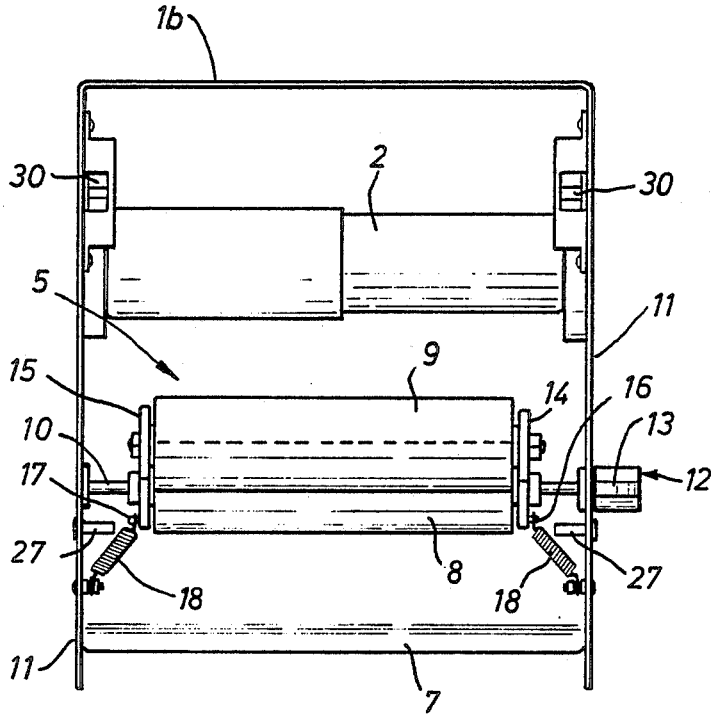
FIG. 1B is a schematic view of a second part of the dispenser of FIG. 1.

Referring to the drawings there is shown a toilet roller dipenser 1, comprising a holder 2 for a toilet roll 3, a medicament reservoir 4, and means 5 operable selectively to apply medicament to a part of a surface of a toilet roll as it is dispensed.

The dispenser 1 is essentially in two parts, comprising a wall mountable plate or first part 1*a* carrying the medicament reservoir 4, and having holes 5' or slots through which mounting means such as screws can be passed into a wall for mounting the dispenser 1 on the wall, (not shown). There is also a second part or box, cover or housing 1*b*, the dispenser 1 having a lower dispensing outlet, exit or slot 6 at the front (as considered in use) formed between a lip 7 and the reservoir 4. The first and second parts are releasably joined together to complete the dispenser by engaging studs in slots.

Mounted interiorly of the box 1*b*, transversely thereof, there is a spindle comprising the holder 2, which spindle 2 passes through the usual tube of a toilet tissue roll 3 to hold same in position. Below the spindle 2 there is a train of rolls 8 and 9, comprising the means 5, which are parallel to the spindle 2 and to each other. One of the rolls 8 lies fixed in the sense that its axis of rotation remains in the same plane 9 although the roll 8 can freely rotate about a spindle 10 forming its axis of rotation. The spindle 10 passes through side walls 11 of the box 1*b* in which it is mounted for rotation, and one end has secured to it a handle 12 having a manually operable part 13 which is spaced from the adjacent side wall 11. The spindle 10 also mounts two brackets or levers 14 and 15 between which at one end there is secured a spindle 16 on which the other roll 9 is mounted for free rotation.

The opposite ends of the levers 14 and 15, which are substantially parallel, extend beyond the spindle 10 towards the front of the dispenser as considered in use, and their respective free ends 16 and 17 are connected with the respective adjacent side walls 11 of the box 1*b* by biassing means in the form of coil springs 18. The biassing means 18 act normally to maintain the rolls 8 and 9 in the position shown in FIG. 2. Thus the other roll 9 normally lies with its axis of rotation in the same plane 19 as the axis of rotation of the roll 8. A line 20 through the centres of the rolls 8 and 9 in a second position of the roll 9, passes through the centre of the fixed roll 8, which thereby is essentially the pivot point for the movable roll 9. A plane 21 through the axis of rotation of the roll 9 is then below that of the roll 8 (FIG. 3).

Below the roll 9 is the reservoir 4 for medicament, which can be a liquid, gel or the like, and can be in the form of a biocide. Partially immersed in the medicament there is a pick-up roller 22 mounted via extensions 23 in mounting blocks or trunnions 24 on the side walls 25 of the reservoir. The pick-up roll 14 is freely rotatable, as are the rolls 8 and 9.

Figure 4:
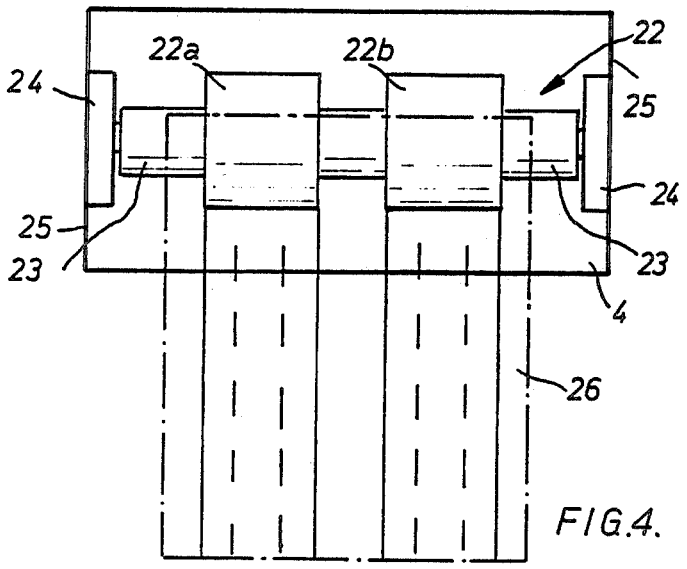
FIG. 4 is a schematic plan view of a first embodiment of pick-up roller used in the dispenser of FIG. 1.

The pick-up roller 22 may be formed as two spaced roll parts 22*a* or 22*b*, as shown in FIG. 4 or as a single roll part 22*c* which lies intermediate the edges of a toilet roll strip or strand 26. In either embodiment, the total width of the roller parts 22*a*, 22*b* or 22*c* (the respective roller parts being carried on extensions (23)) is less than the width of the toilet roll strand 26.

In use, assuming the dispenser 1 is mounted on a wall via screws through the slots 5' in the back plate 1a, the housing or box 1*b* is removed by hinging about inwardly directed lugs 27 in slots 28 to release studs 29 from sockets 30 and lifted away from the first part 1*a* to expose the interior, and a toilet roll 3 is mounted on the spindle 2 and trained round the rolls 8 and 9 as shown. The second part 1*b* is then re-mounted on the first part 1*a* by engaging the lugs 27 in the slots 28 and feeding free end 31 of the toilet roll through the dispensing slot 6 before the dispenser 1 is closed to engage the studs (which have heads grippable by the sockets) in the sockets.

Figure 2:
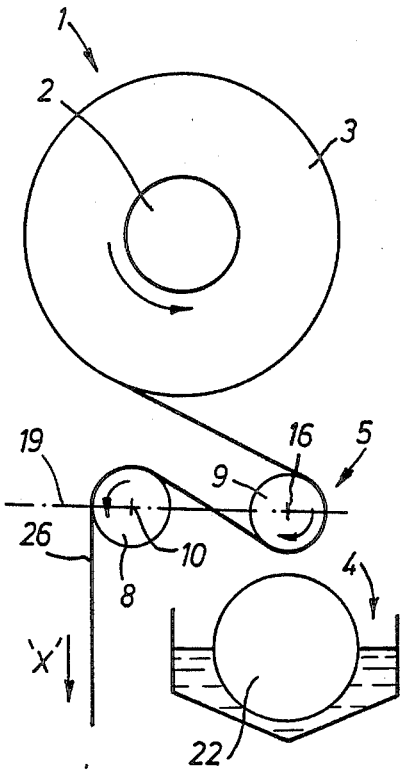
FIG. 2 is a schematic view of the interior of the dispenser of FIG. 1, in a first operational mode.
Figure 3:
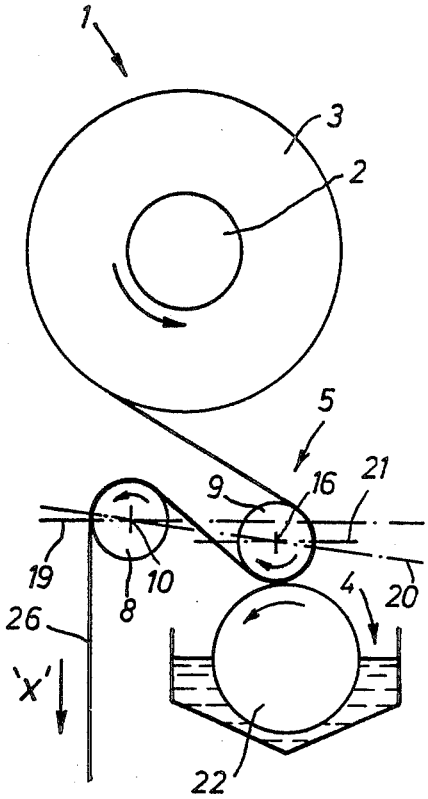
FIG. 3 is a schematic view of the interior of the dispenser of FIG. 1, in a second operational mode.

If it is desired to dispense un-medicated toilet tissue, the exposed end 31 is pulled in the direction of arrow 'x' and torn off along the usual perforations, the rolls 8 and 9 being in the mode shown in FIG. 2.

If however it is desired to dispense medicated toilet tissue, it is merely necessary to depress the handle 13 in the direction of the arrow "Y". This action results in rotation of the spindle 10 and hence of the levers 14, 15 which are solid with the spindle 10, against the action of the springs 18. The levers 14, 15 move up at the end adjacent the springs 18 and down at their opposite ends, so that the roll 9 is moved down so that tissue trained round that roll contacts the pick-up roller 22, as shown in FIG. 3. A pull on the free end of the tissue causes the rolls 8 and 9 to rotate, and, by friction, causes rotation of the roller 22 so that it picks up medicament from the reservoir 4 and applies it to the strand of tissue 26 as it passes over the pick-up roller 22. Whichever embodiment of pick-up roller 22 is used, the whole width of the strand 26 of toilet paper/tissue is not moistened. With a high quality or "soft" tissue this partial application provides a required level of medication of the tissue which maintaining its strength so that it does not tear. The roller parts 22*a* and 22*b* give a different degree of medication to roller part 22*c*.

When the medicated tissue has been dispensed, the handle 13 is released so that the movable roll moves under the influence of the biassing means 18 back to the position shown in FIG. 2.

Figure 5:
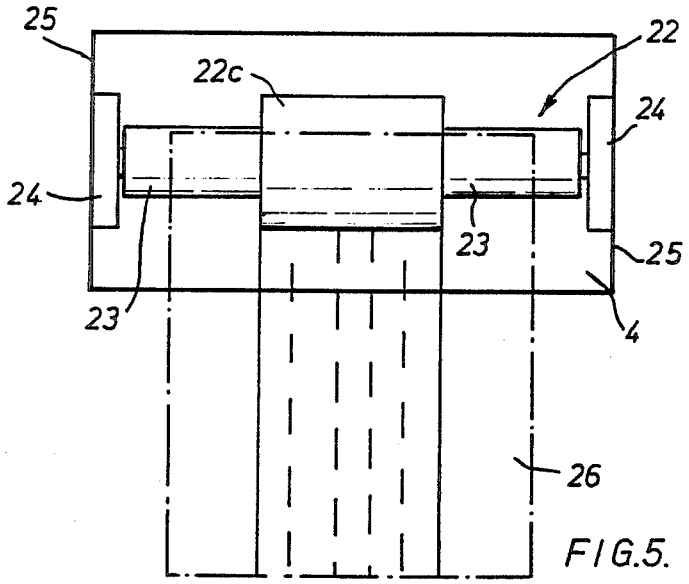
FIG. 5 is a schematic plan view of a second embodiment of pick-up roller used in the dispenser of FIG. 1.

The pick up roller 22 is replacable, in other words the roller shown in FIG. 4 can be removed and replaced by that shown in FIG. 5, and vice versa.

Thus by altering the relative position of the rolls 8, 9 and roller 22, the toilet tissue or other strand is brought into contact with the medicament, or other liquid or gel. It will also be understood that the invention is applicable to other strands other than toilet tissue, for example, paper, cloth, plastics or other material which it is desired to wet across only a part of its width.

I claim:

1. A dispenser for strip material, comprising:

(i) a body;

(ii) a holder for a roll of strip material;

(iii) a reservoir for flowable material;

(iv) a roller in the reservoir, mounted for free rotation and having a roller part which picks up flowable material for distributing same from the reservoir, which roller part has a width which is of less width than the roll of strip material; and (v) means operable selectively to dispense dry strip material and strip material to which flowable material has been applied as a strip by said roller part of said roller in the reservoir, said means comprising:

(a) two rollers which are freely rotatable about respective axes of rotation, strip material from the roll being trained round both rollers from opposite sides of said axes and one of which rollers is mounted on an axis in a fixed plane and the other of which is mounted so that its axis can be moved below the plane of the axis of said one roller whereby the other roller is movable bodily from a rest position to a position to form a nip with the roller in the reservoir whereby the strip material is dispensed dry in the rest position and wet in the contact position.

2. A dispenser for strip material as defined in claim 1, wherein said one roller is mounted on a spindle which has an extension to which is applied a manually grippable part exteriorly of the body for moving said other roller between said two positions.

3. A dispenser for strip material as defined in claim 1, wherin there is means operative to bias said bodily movable roller to said rest position.

4. A dispenser for strip material as defined in claim 3, wherein said biasing means comprises parallel levers mounting the bodily movable roller and springs connecting the levers with the body and normally acting to maintain the bodily movable roller in the rest position.

5. A dispenser for strip material as defined in claim 1, wherein the bodily movable roller is moved vertically to the contact position.

6. A dispenser for strip material as defined in claim 1, wherein the roller in the reservoir has two spaced roller parts whereby to apply two separate strips of flowable material to the strip material, which strips together have a width less than the width of the strip material.

7. A dispenser for strip material as defined in claim 1, wherein the strip material is a paper toilet roll and the flowable material is a liquid medicament.

8. A dispenser for strip material, comprising:

a holder for a roll of strip material;

a reservoir for flowable material;

a reservoir roller in the reservoir, mounted for free rotation and having a roller part which picks up flowable material for distributing same from the reservoir; and means for selectively dispensing dry strip material and strip material to which flowable material has been applied by said roller part, said means comprising:

first and second paper rollers which are freely rotatable about respective axes of rotation, strip material from the roll being trained round both rollers from opposite sides of said axes, the first paper roller being mounted such that its axis is fixed and the second paper roller being mounted such that its axis is movable whereby the second paper roller is movable from a rest position in which the strip material is dry as it is dispensed to a position where the second paper roller forms a nip with the reservoir roller whereby the strip material is wet with the flowable material as it is dispensed.

* * * * *